US005307233A

United States Patent [19]

Forry

[11] Patent Number: 5,307,233

[45] Date of Patent: Apr. 26, 1994

[54] ELECTRICALLY CONDUCTIVE MATERIAL

[75] Inventor: John S. Forry, Lancaster, Pa.

[73] Assignee: Armstrong World Industries, Inc., Lancaster, Pa.

[21] Appl. No.: 706,358

[22] Filed: May 28, 1991

[51] Int. Cl.[5] ..... H05F 3/00

[52] U.S. Cl. ..... 361/220; 428/327; 524/914

[58] Field of Search ..... 361/212, 215, 216, 220; 156/71, 273.9, 297; 428/327, 379, 403; 524/910–914

[56] References Cited

U.S. PATENT DOCUMENTS

| | | | |
|---|---|---|---|
| 2,457,299 | 12/1948 | Biemesderfer | 361/220 |
| 3,040,210 | 6/1962 | Charlton et al. | 361/212 |
| 3,132,065 | 5/1964 | Barsy et al. | 361/220 X |
| 3,386,001 | 5/1968 | Slosberg | 361/220 |
| 3,845,353 | 10/1974 | Shirai et al. | 361/220 |
| 4,496,627 | 1/1985 | Azuma et al. | 428/336 |
| 4,826,912 | 5/1989 | Ko et al. | 524/914 X |
| 4,885,659 | 12/1989 | Nowell et al. | 361/212 |
| 4,908,258 | 3/1990 | Hernandez | 428/198 |
| 4,944,998 | 7/1990 | Ko et al. | 428/327 |
| 5,091,452 | 2/1992 | Ko et al. | 524/914 X |

*Primary Examiner*—A. D. Pellinen
*Assistant Examiner*—Fritz M. Fleming

[57] ABSTRACT

A novel product is disclosed comprising a single layer of thermoplastic chips having electrically conductive material coated on the vertical edges of the chips disposed on a continuous electrically conductive support, bonded thereto and to each other and consolidated to form a continuous, electrically conductive sheet.

9 Claims, 3 Drawing Sheets

ELECTRICALLY CONDUCTIVE MATERIAL

FIELD OF THE INVENTION

This invention relates to an electrostatic-conductive, resilient floor covering. More particularly, it relates to vinyl plastic structures in the form of sheets or films, having the capability of conducting static electricity from the top exposed surface of the structure to its bottom unexposed surface.

BACKGROUND OF THE INVENTION

In today's high tech environment, static electricity is more than just the annoyance of a little shock on a dry winter's day. Sensitive electronic components can be damaged or degraded by electrostatic discharges. Besides causing equipment to malfunction, static can ignite flammable gases. And the static discharge doesn't require a dry winter's day.

Low humidity, air conditioned rooms provide the "dry winter's day" atmosphere all year round. Thus, computer terminals, data-processing equipment, coronary care units, radiological facilities, and the like, all housed in such rooms are all candidates for destruction by electrostatic discharges.

In a paper presented at the 1984 Nepcon West Conference "Choosing a Floor Management Program for Effective Static Control", Michael T. Brandt points out:

"One of the prime generators of static in any populated environment is the movement of personnel or equipment across a floor surface. The interaction between shoe or caster and floor surface can generate significant static voltages as shown in Table I.

TABLE I

Typical Electrostatic Voltages

| Means of Static Generation | Electrostatic Voltages 10-20% R.H. | 65-90% R.H. |
|---|---|---|
| Walking across carpet | 35,000 | 1,500 |
| Walking over vinyl floor | 12,000 | 250 |
| Worker at bench | 6,000 | 100 |
| Mobile storage carts on vinyl floors | Up to 5,000 Volts | |

Static would be less of a problem if personnel were stationary, if they didn't move about. If they remained at their work stations. If they didn't move products from one area to another. But the fact is, movement exists and static is generated throughout the entire work environment."

PRIOR ART

For a clearer understanding of the prior art and the present invention, the technical electrical terms, as used in this specification, are defined, as follows:

"electrically conductive" means surface resistivities of less than $10^{13}$ ohms per square;

"static dissipative" means surface resistivities of from $10^6$ to $10^9$ ohms per square; and "conductive" means surface resistivities of from $10^3$ to $10^5$ ohms per square.

In his paper, Mr. Brandt suggests a number of alternative static control programs for floors: (1) Floor mats, (2) topical treatments, and (3) floor coverings.

The floor mats are usually black, carbon-filled, conductive mats of either rubber, vinyl, or polyolefin. They usually display an electrical resistance of $10^3$ to $10^5$ ohms per square.

As an alternative to carbon, antistatic agents such as those in the quaternary amine family have been used. Products containing these agents usually display an electrical resistance of $10^6$ to $10^9$ ohms per square. However, the performance of these products leaves much to be desired. They are highly sensitive to humidity and their electrical conductivity tends to deteriorate over the long term.

Floor mats, in general, are loose-lay materials usually grounded through a one megohm current limiting resistor. Static decay rates per Federal Test Method 4046 range from 0.01 second to more than 10.0 seconds.

Floor mats have limitations. They provide only localized protection. They tend to curl and must be taped down to hold them in place and to reduce tripping hazards. They complicate normal floor maintenance procedures and wear out with use, requiring costly replacement. And the carbon-filled mats are not applicable for clean room situations due to the potential for particulate contamination.

The topical treatments include conductive paints or coatings. The paints or coatings are usually carbon loaded and messy to work with; are subject to wear, flaking and chipping; and require frequent reapplication. The topical antistats are really not intended for floors. They are not scuff resistant and because most are soluble in water and solvents, the flooring cannot be cleaned without constant reapplications.

Conductive vinyl flooring, the best solution, is currently available as tiles, usually 12"×12", or in 36"×36" sections, or as sheet goods. The sheet goods, however, when carbon-filled, tend to be entirely black or smudgy due to numerous black streaks; and are physically similar to conductive matting.

The tile products have more pattern with the conductive material distributed in vein-like array throughout the flooring to provide through-tile conductivity. However, the cost of producing tiles that do not exhibit the characteristic black, smudgy surfaces of carbon black-filled materials is extremely high. Since all sides of chips used in manufacturing the tiles are coated with the carbon black-filled material, it is necessary to add the step of cleaning the surface of the tiles by sanding or other treatment. Alternatively, this tile product can be produced by forming a block from the consolidated chips which is then sliced to yield tiles of nominal thickness; and these tiles must then be sanded or otherwise brought to a uniform gauge. Of course, any of these additional processing steps add significantly to the cost of the product.

The product's surface also displays a characteristic uncontrollable and unreproducible veining pattern due to the random distribution of conductive carbon throughout the thickness of the tile. Upon installation, conductive adhesive must be used to transmit the electrostatic charge that hopefully has been transmitted through the tile's thickness lateral to ground. Together the system of tile and adhesive creates a cumbersome pathway of electrical conductivity to ground. Conductive vinyl flooring has an electrical resistance between $2.5\times10^4$ and $10^6$ ohms per square and exhibits static decay rates of less than 0.03 second per Federal Test Method 4046.

The biggest advantage of conductive vinyl flooring as sheeting or tiles is that it provides complete environmental protection without the need for additional floor mats or topical treatments. It requires no special maintenance to retain its conductivity and such flooring is relatively insensitive to humidity. Conductive flooring also may be used in clean rooms.

It is an object of this invention to provide flooring that will dissipate dangerous electrostatic charges. It is also an object to provide flooring that is visually attractive, that doesn't display the characteristic solid or smudgy black of prior art static dissipative floor coverings, nor the random, uncontrollable black veining of the prior art conductive or static dissipative tiles. It is a further object to provide a quality conductive floor covering as tough, flexible sheeting or tiles that can be manufactured economically and, as sheeting, installed easily.

SUMMARY OF THE INVENTION

This invention provides a novel electrically conductive product in the form of sheeting or tile, the product being composed of a plurality of vinyl chips of predetermined geometric shape or pattern bonded as a continuous sheet along the vertical edges or sides of the chips, the vertical edges being coated with an electrically conductive material, preferably fine carbon black particles, the faces or horizontal surfaces of the chips being substantially devoid of electrically conductive particles.

The chips may be and, in our best mode embodiment, are prepared by extruding a continuous rod of polyvinyl chloride or other non-electrically conductive thermoplastic material having a circular, rectangular, triangular or other geometric cross-section; coating the surface of the rod with an electrically conductive coating, preferably a dispersion of conductive carbon black; and, thereafter, slicing the coated rod into chips of any desired thickness, usually anywhere from about 30–90 mils.

To produce sheeting, a conventional resilient flooring felt backing is first coated on at least one surface with an electrically conductive material, usually a polyvinyl chloride latex having conductive carbon black dispersed therein. The coated chips are then distributed substantially uniformly onto the coated surface of the felt backing and, by vibrating or other means, the chips are arranged in an array such that a single layer of chips covers the felt backing with the coated edges of the chips disposed vertically and in contact with the conductive coating on the surface of the felt; thereafter, heat may optionally be applied to tack the layer of chips to the felt, followed by the application of additional thermoplastic material, the "dry blend", which fills any void spaces in the substantially flat, single layer array of chips; when the combination of felt and chips is subsequently heated to soften the thermoplastic material, the "dry blend" acts as the mortar to bind the chips to each other and to the underlying felt and thus form the sheeting. The sheeting, while still warm, may be passed through the nip of rolls to consolidate the materials at a predetermined uniform thickness. The fused consolidated product is then cooled, usually by exposure to air, prior to being stored, usually by winding on a cylindrical roller.

To produce tiles, a similar process is usually followed but using a so-called "release felt" on which to consolidate the edge conductive chips and the mortar. The electrically conductive coating on the felt is optional. After consolidation by heating and applying pressure, the resulting sheet of fused consolidated chips with the releasable backing is allowed to cool before it is cut into tiles of any desired dimensions, e.g., 12 inch by 12 inch, 6 inch by 12 inch, etc. Upon installation, the release felt is removed and an electrically conductive adhesive, as in the prior art, is used to secure the tiles to the floor.

It should be appreciated that the resulting sheeting or tiles display a visual appearance that is substantially free of any color contribution from the conductive material. The conductive particles are relegated to the thinnest of coatings on the vertically disposed edges of the chips. In addition, the density of even these thin conductive lines can be engineered, e.g., by the appropriate choice of the chip's dimensions, to be precisely the density required by electrically conductive flooring code specifications.

By employing the present invention, an electrically conductive product can be manufactured using simple processing steps with the optimum use of the conductive material. In short, the efficient use of materials and process steps produces electrically conductive flooring at minimum expense. In fact, these efficiencies permit the use of more expensive, but less obtrusive conductive materials such as zinc oxide or nickel coated mica instead of the customary carbon black.

DETAILED DESCRIPTION OF THE INVENTION

Figure 1:
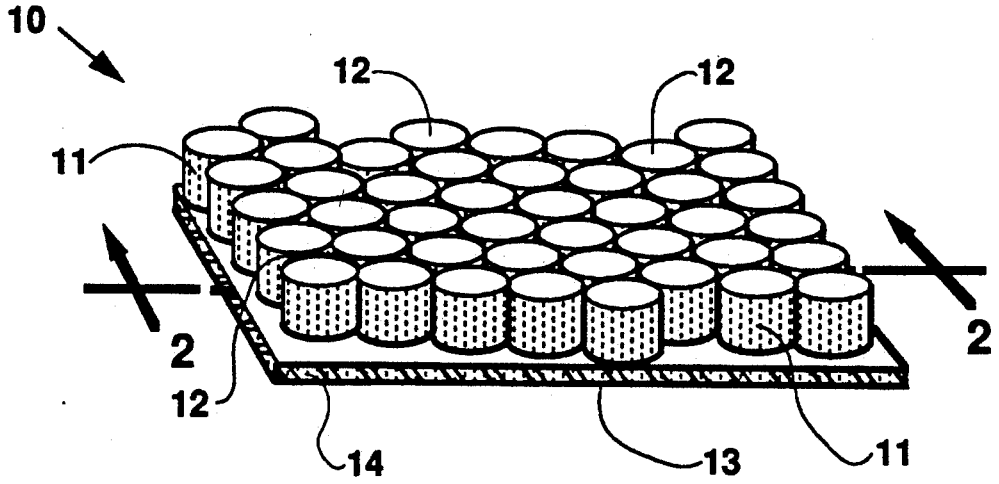
FIG. 1 is a perspective view of one embodiment of the electrically conductive resilient sheet material of the present invention.
Figure 2:
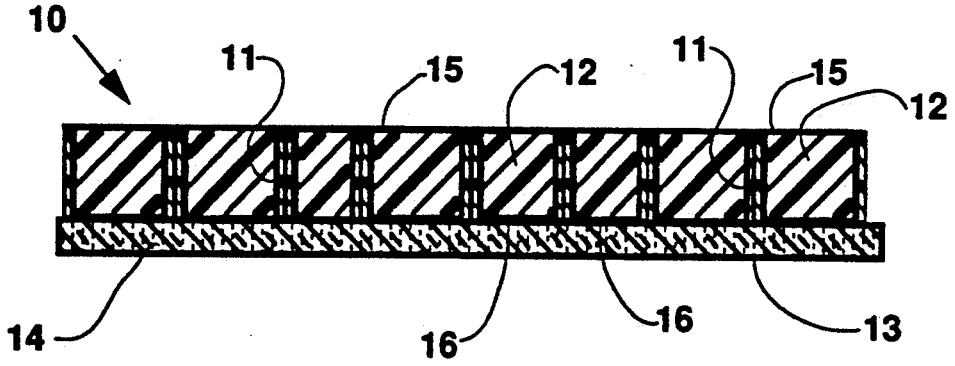
FIG. 2 is a cross-sectional elevation view along the line 2—2 of FIG. 1.
Figure 3:
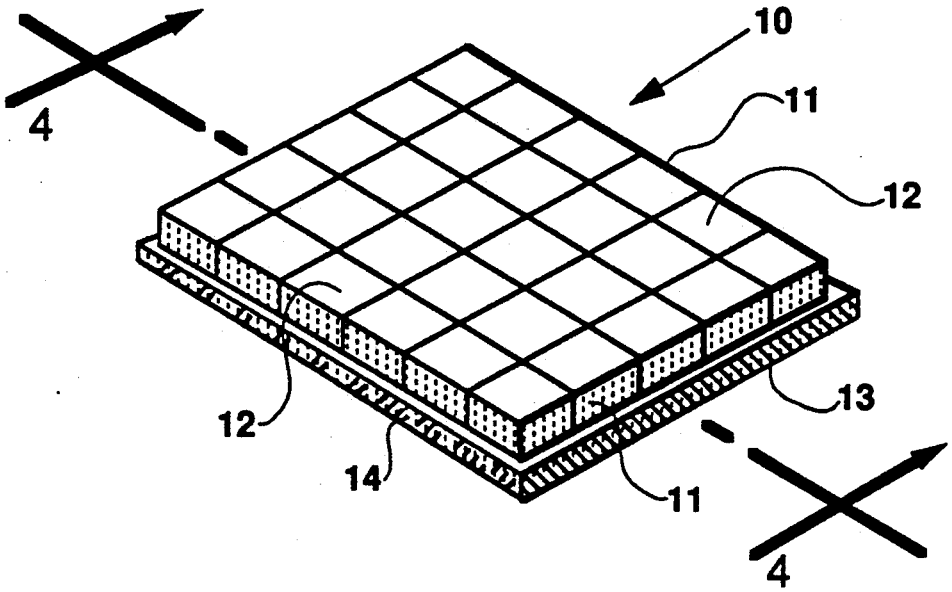
FIG. 3 is a perspective view, similar to FIG. 1, of another embodiment of the present invention.
Figure 4:
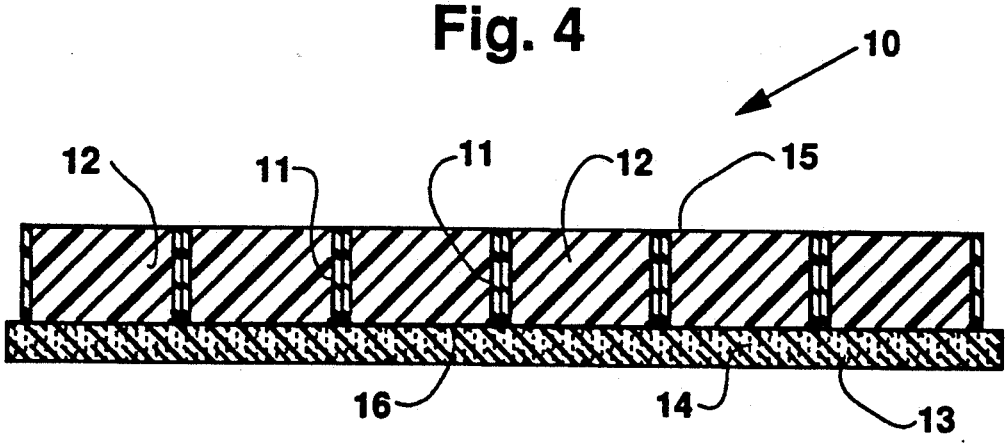
FIG. 4 is a cross-sectional elevation view along the line 4—4 of FIG. 3.

Referring first to FIGS. 1 and 2, and FIGS. 3 and 4 the electrostatic-conductive flexible sheet material is shown generally at 10. The flexible sheet 10 is composed of a monolayer of polyvinyl chloride pellets or chips 12 that have been coated with an electrically conductive coating 11 of conductive particles of carbon black or zinc oxide or the like dispersed in a polymeric latex, e.g., polyvinyl chloride. Additional polymer may have been added to fill any voids between the coated chips 12. The coated chips 12 are arranged as a single layer on a felt backing 13 that has been impregnated or coated with electrically conductive particles 14. The resultant sheeting will have electrically conductive material exposed at its top surface 15 and at its bottom surface 16. Thus, the electrostatic charges produced by the movement of shoes or casters on flooring at the top surface will be dissipated through the vertically disposed conductive coating in the floor covering to the electrically conductive backing 13 in the case of sheeting or electrically conductive adhesive coating in the case of tiles; and from there to a ground connection at the perimeter of the floor.

The material used to produce the chips is preferably a vinyl resin, i.e., a polymeric material obtained by polymerizing compounds containing at least one —CH=CH$_2$ radical. Useful vinyl resins include homopolymers, such as polyvinyl chloride, polyvinyl acetate, polyvinyl propionate, polyvinyl butyrate, polymerized vinylidene chloride, polymerized acrylic acid, polymerized ethyl acrylate, polymerized methyl acrylate, polymerized propyl acrylate, polymerized butyl acrylate, and the like; copolymers of the above with each other such as vinyl chloride-vinyl acetate copolymer, vinylidene chloride-vinyl chloride copolymer, methyl methacrylate-vinyl chloride copolymer, methyl acrylate-ethyl acrylate copolymer, ethyl acrylate-butyl acrylate copolymer, and the like and copolymers of the above with other monomers copolymerizable therewith, such as vinyl esters, including vinyl bromide, vinyl fluoride, vinyl choroacetate, vinyl alkyl sulfonates, trichloroethylene and the like; vinyl ethers such as vinyl ethyl ether, vinyl isopropyl ether, vinyl chloroethyl ether and the like; cyclic unsaturated compounds such as styrene, chlorostyrene, coumarone, vinyl pyridine and the like; maleic and fumaric acid and their derivatives such as diethyl maleate, dibutyl fumarate and the like; unsaturated hydrocarbon such as ethylene, propylene, butylene and the like; allyl compounds such as allyl acetate, allyl chloride, allyl ethyl ether, and the like; conjugated and cross-conjugated unsaturated compounds such as butadiene, isoprene, chloroprene, 2,3-dimethylbutadiene-1,3, divinyl ketone and the like. The monomers listed hereinabove are useful in preparing copolymers with a vinyl resin and can be used as modifiers in the polymerization, in which case they may be present in an amount of a few percent, or they can be used in larger quantities, up to as high as 40 percent by weight of the mixture to be polymerized. If desired, a mixture of vinyl resins can be used in preparing the polymeric rod 21 shown in FIG. 5 for use in the invention.

The high molecular weight and chemical and physical nature of polyvinyl chloride allow it to accommodate relatively large amounts of inert filler and it can be plasticized effectively and permanently to create materials with a wide range of flexibilities. Polyvinyl chloride is inherently resistant to acids, alkali and many organic solvents. It does not hydrolyse even when in continuous contact with moisture. Because of its chlorine content, the polymer is also inherently fire resistant and as a plastic material is generally classified as self-extinguishing. Plasticized material is less fire resistant than rigid PVC, but can usually be formulated for use as a floor covering to pass the flame spread and smoke generation limitations of most building codes.

When properly compounded and processed, PVC can be a clear, colorless material or pigmented to produce the full range of colors in transparent or opaque forms.

Polymeric material, as used throughout this specification, is intended to include polyvinyl chloride in its various forms. The vinyl resins used in floor coverings may be homopolymers, i.e., polymers consisting of only vinyl chloride units, or copolymers, consisting of vinyl chloride and other structural units, such as vinyl acetate. The molecular weights of these resins typically range from about 40,000 to about 200,000 atomic mass units. The higher molecular weight polymers have greater ultimate tensile strength and abrasion resistance and are generally used in flooring wear layers, while the lower molecular weight polymers are most useful in producing foams for cushioned flooring. As a general rule, vinyl homopolymers are typically used in vinyl sheet goods and Type III solid vinyl tile, while Type IV vinyl composition tiles typically contain copolymers of vinyl chloride and vinyl acetate.

To protect the polymeric material from degradation during processing and during its use as flooring material, vinyl compounds should be stabilized against the effects of heat and ultraviolet radiation. The most common stabilizers used in flooring are soaps of barium, calcium and zinc; organo-tin compounds; epoxidized soy bean oils and tallate esters; and organic phosphites.

Polymeric materials for flooring uses, even for use in relatively rigid Type IV vinyl composition tiles, contain plasticizers to provide flexibility and to facilitate processing. The most frequently used plasticizer is dioctyl phthalate (DOP). Others that may be found in flooring use include butylbenzyl phthalate (BBP), alkylaryl phosphates, other phthalate esters of both aliphatic and aromatic alcohols, chlorinated hydrocarbons, and various other high boiling esters. The selection of the proper type and amount of plasticizer is often critical in the formulation of flooring compounds because of the interaction of flexibility requirements, resistance to staining, reaction with maintenance finishes, and processing requirements.

For tile and sheet flooring, the stabilized and plasticized vinyl formulation may be mixed with varying amounts of inorganic filler to provide mass and thickness at a reasonable cost. The most common filler typically found in flooring is crushed limestone (calcium carbonate). Others that may be employed include talcs, clays and feldspars In addition to providing bulk at reasonable cost, the use of inorganic fillers in flooring structures provides increased dimensional stability, resistance to cigarette burns, improved flame spread ratings and reduced smoke generation.

Pigments may also be used in flooring products to provide both opacity and color to the finished products. The typically preferred white pigment is titanium dioxide and colored pigments are preferably inorganic. Certain colors only available as lakes, such as the phthalocyanine blues and greens, must be resistant to the effects of alkali and light fading.

Finally, in order to pass certain code requirements with regard to fire and smoke properties various additives may be employed to reduce flame spread and smoke generation ratings. These compounds include alumina trihydrate, antimony trioxide, phosphate or chlorinated hydrocarbon plasticizers, zinc oxide, and boron compounds. Cushioned flooring containing chemically expanded foam is usually compounded with azobisformamide blowing agents. Various other processing aids and lubricants may also be employed.

While there is no requirement to do so, appropriate typical antistatic agents, usually of the quaternary amine family, may be employed in the formulation of the polymeric components of this invention to add to the electrical conductivity.

The thickness of the relatively flat chips 12 will depend to a large extent upon the particular product to be made and the particular subsequent use for which it is intended. Normally, a thickness in the range of from about 10 mils to about 90 mils is satisfactory.

Figure 5:
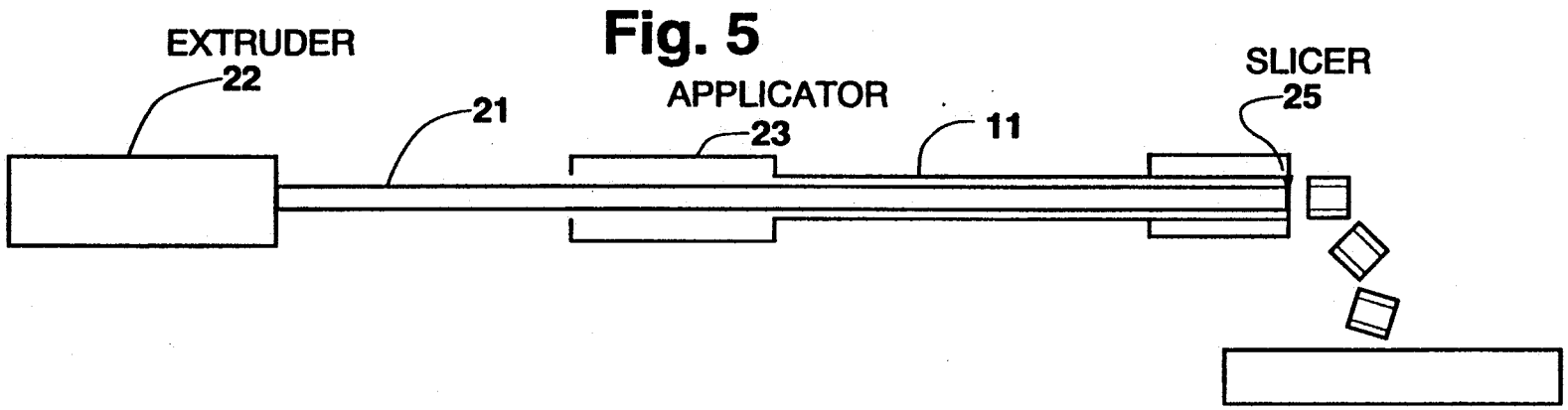
FIG. 5 is a schematic view of a process and equipment used in the manufacture of the chips used in the sheeting or tiles of the present invention.

The chips 12 having the electrically conductive coating 11 may be prepared by the process shown schematically in FIG. 5. Specifically, the polymeric material, preferably filled polyvinyl chloride, is extruded as a continuous rod 21 from extruder 22. The rod 21 is passed through an applicator 23 where the electrically conductive coating 24 is applied. The applicator 23 may constitute a bath containing the dispersion of particles of graphite, carbon black, zinc oxide, nickel-coated mica or other electrically conductive materials in a liquid latex composition. Excess coating may be removed by passing the rod through a wiper, not shown. The applicator 23 might also be a metallizing chamber where a layer of copper, nickel, tin or any other suitable electrically conductive material may be applied to provide a thin metallized outer layer 11 covering the surface of rod 21. The coated rod 21 is then led to a slicer 25 where the rod 21 is sliced into chips 12, usually 30–90 mils thick, preferably about 60 mils thick, with their edges substantially covered with the electrically conductive coating 11.

It will be appreciated that the use of metallizing or metallic particulates as the conductive medium in the electrically conductive coating would provide conductivities that exceed $10^3$ ohms. Therefore, such use would normally produce an electrical shock hazard. However, the practice of the present invention does not produce this hazardous situation. There is no direct surface connection between the various conductive elements. If desired, the continuity of the electrically conductive coating around the perimeter of the chips can be interrupted by scoring through the coating on the rod 21 along the machine direction axis, thereby unequivocably eliminating any shock hazard.

In one mode contemplated for this invention, the electrically conductive coating comprises 15–40 volume percent of Ketjenblack EC-DJ 600* in a soybean modified polyvinyl chloride of 55% solids in mineral spirits.**

* A carbon black product of Akzo Chemie.

** As discussed in "Investigation of Electrical Resistivity—Pigment Relationship in Carbon Black Filled Conductive Paint", A. Calahara, Journal of Coatings Technology, Vol. 60, No. 757, February, 1988.

The preferred dispersion for coating rod 21 comprises: 100 parts of "Geon" 576[1], 3 parts of "Triton" X-155[2] and 30–85 parts of "Aquablack" 548–17[3]. It should be understood that any of the anti-static dispersions or paints including those of carbon black, the quaternary ammonium salts, e.g., "Larostat" 264-A[4], "Cyostat" LS[5] and "Hexcel" 106G[6], may also be used.

[1] A polyvinyl chloride latex (57.5% solids) manufactured by B. F. Goodrich Co.

[2] An alkyl arylpolyether alcohol manufactured by Rohm and Haas Co.

[3] An aqueous dispersion of 20% carbon black particles manufactured by Borden Chemicals and Plastics Co.

[4] M-cocoa-dihydroxyethyl-ethyl ammonium ethyl sulfate manufactured by Mazer Chemical Company.

[5] (3-lauramidopropyl) trimethyl-ammonium methyl sulfate manufactured by American Cyanamid Co.

[6] M,N-bis-(2-hydroxy-ethyl)-methyl, octyl ammonium 4-methyl-benzene sulfonate manufactured by Hexcel Chemical Products Co.

Figure 6:
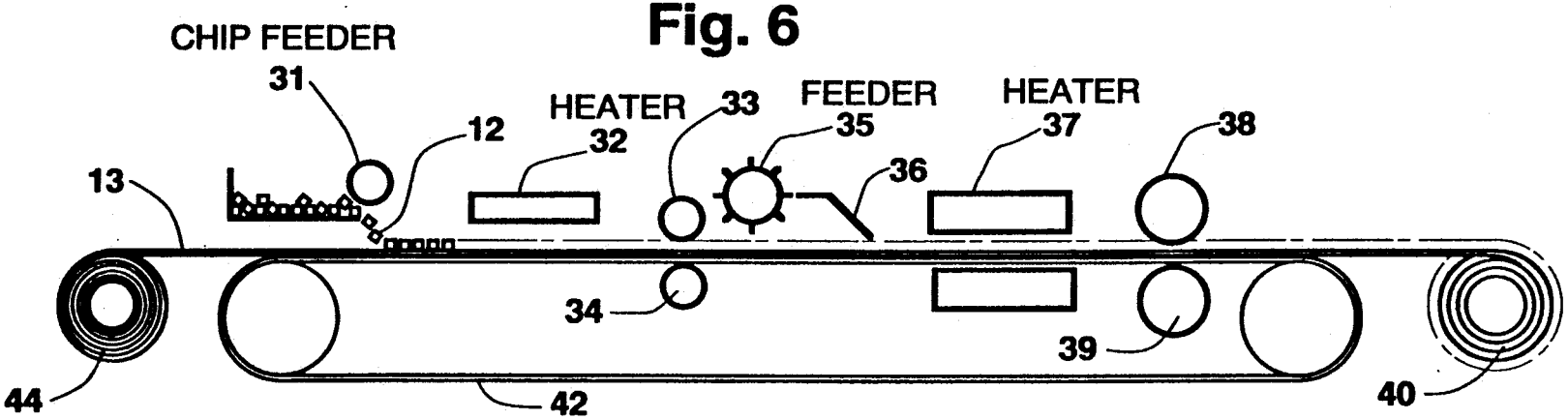
FIG. 6 is a schematic view of a process and equipment used in the manufacture of the sheeting of the present invention.

The process of converting the coated chips 12 into a final product, continuous sheeting or tiles, is shown schematically in FIG. 6. The conductively-coated or impregnated felt 13, about 25 mils thick, is unwound from the roll 44 and passed onto a belt 42 beneath the outlet of a chip feeder 31 equipped with an oscillator blade and containing the coated chips 12. The chips 12 are deposited onto the surface of the continuously moving felt 13. Excess chips may be removed by means, not shown, to provide a single layer of chips 12 on the felt backing 13, with the edges of coated chips 12 in substantial contact with each other. The felt covered with the layer of chips is then passed through heater 32 at a temperature of about 300° F. and then between rolls 33 and 34 where the layer of chips is tacked to the electrically conductive felt 13.

A "dry blend" of the polymer is then fed through feeder 35 onto the surface of the coated felt. Excess polymeric material is screeded from the surface at 36; and the material is passed through heater 37 at about 400° F. where the dry blend softens in the spaces between chips. The felt 13 covered with the single layer of chips 12 and filled with softened polymer in any voids between chips is next passed through the nip of rolls 38 and 39 where the material is consolidate and its thickness controlled to about 60 mils. The resulting sheeting is permitted to cool at ambient temperature and is wound on roll 40, prior to storage and shipping.

What is claimed is:

1. Electrically conductive sheeting comprising a plurality of polymeric chips of pre-determined shape, each having an upper surface, a lower surface and at least one vertically disposed edge between said surfaces; an electrically conductive material coating the surface of said vertically disposed edge extending from said upper surface to said lower surface of said chip sufficient to transmit electrostatic charge from the upper surface to the lower surface of the article, said chips arranged as a single layer bonded along the vertically disposed edges to form electrically conductive sheeting.

2. Sheeting as in claim 1 wherein said polymeric chips are filled polyvinyl chloride chips.

3. Sheeting as in claim 1 wherein said electrically conductive material is electrically conductive carbon black.

4. Sheeting as in claim 1 wherein said electrically conductive material is a conductive metal in the form of particles.

5. Sheeting as in claim 1 wherein said vertically disposed edges are metallized.

6. Sheeting as in claim 1 wherein one surface of said sheeting has a continuous electrically conductive coating thereon in electrical contact with said electrically conductive material coating the surface of said vertically disposed edges of said chips of said sheeting.

7. Sheeting as in claim 6 wherein said continuous electrically conductive coating is disposed on a supporting sheet bonded to said one surface of said sheeting.

8. Sheeting as in claim 1 wherein said chips are arranged as a single layer disposed on a continuous support and bonded thereto.

9. A process for manufacturing electrically conductive sheeting which comprises moving a conductively-coated or impregnated support; beneath the outlet of a chip feeder distributing a single layer of a plurality of thermoplastic chips to substantially cover said moving support, said chips, each having an upper surface, a lower surface, vertically disposed edges coated with an electrically conductive material and the distance between upper and lower surfaces being from about 30 mils to about 90 mils; adding thermoplastic material onto said layer of chips to fill any void spaces between chips; heating and applying pressure to consolidate said single layer of chips and said support into electrically conductive sheeting.

* * * * *